US008056893B2

(12) United States Patent
Mandel et al.

(10) Patent No.: US 8,056,893 B2
(45) Date of Patent: Nov. 15, 2011

(54) MEDIA TRANSPORT SYSTEM

(75) Inventors: Barry P. Mandel, Fairport, NY (US); Linn C. Hoover, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/732,687

(22) Filed: Mar. 26, 2010

(65) Prior Publication Data

US 2011/0233845 A1 Sep. 29, 2011

(51) Int. Cl.
*B65H 83/00* (2006.01)

(52) U.S. Cl. ..... 271/3.21; 271/3.22; 271/3.23; 271/267; 271/276

(58) Field of Classification Search ..... 198/689.1, 198/468.01; 271/3.18, 3.21, 3.22, 3.23, 167, 271/275, 276, 266, 107, 194–197; 400/627–629.1, 400/648, 655
See application file for complete search history.

(56) References Cited

U.S. PATENT DOCUMENTS 7,017,640 B2 * 3/2006 Winter et al. ..... 156/562

* cited by examiner

*Primary Examiner* — Michael McCullough
(74) *Attorney, Agent, or Firm* — Hoffmann & Baron, LLP

(57) ABSTRACT

A system and method for transporting a sheet of media through a print zone including a media entrance station, a media exit station and a first media transport translatable in a reciprocal manner between the entrance and exit stations. A second media transport transports a sheet onto and off of the first media transport. The second media transport transports the sheet in a first direction as the first media transport is moving in a second opposite direction.

17 Claims, 8 Drawing Sheets

MEDIA TRANSPORT SYSTEM

TECHNICAL FIELD

The present disclosure relates to a system for transporting sheets of media, and more, particularly, moving sheet of media through a print zone.

BACKGROUND

Document processing devices, such as printers and copiers, include systems for transporting sheets of substrate media there-through. In order to increase the throughput of the device, the transport systems are designed to move the media rapidly along a media processing path. Transport systems may include wide transport belts or the media may be held against a large flat table for printing. One portion of the path which can negatively influence throughput is travel through a print zone in which an image will be imparted thereon. In the print zone, it is important that the movement of the sheet be precisely controlled to establish a high quality output. Moving the media into and out of the print zone in a controlled manner typically requires complicated transfers and involves various steps. Such transfers tend to negatively affect throughput.

Transport issues are especially difficult with relatively large or thick media when using a direct marking system. The use of direct marking systems in high end printing is rapidly expanding. By staggering small print-heads to create wide jetting arrays very fast printing systems can be achieved. One challenge with such systems is holding the media flat in the print zone so that it does not come in contact with any of the print heads. This challenge is even greater from large format sheets and/or long print zones since the overall hold down force over the large print area required can create significant drag making a sliding belt system impractical and create significant motion quality issues. This is especially true when transporting thick media such as folding carton or corrugated board which may require high hold down pressures.

Accordingly, it would be desirable to provide a media transport system and method for efficiently moving media through a print zone to permit high quality outputs.

SUMMARY

According to aspects described herein, there is disclosed a system for transporting a sheet of media through a print zone including a media entrance station, a media exit station and a first media transport translatable in a reciprocal manner between the entrance and exit stations. A second media transport transports a sheet onto and off of the first media transport. The second media transport transports the sheet in a first direction as the first media transport is moving in a second opposite direction.

According to aspects described herein, there is also disclosed a sheet media transport for moving a sheet of media through a print zone including a media entrance station and a media exit station. A sled is translatable in a reciprocal manner between the entrance and exit stations. The sled has a surface in operative communication with a vacuum. A belt assembly transports a sheet onto and off of the sled. The belt assembly is capable of transporting the sheet in a first direction as the sled is moving in a second opposite direction.

According to aspects described herein, there is further disclosed a method for transporting sheets of media through a print zone including:

translating a first sheet transport toward a sheet entrance station;

operating a second sheet transport for moving a sheet of media in a first direction onto the first sheet transport while the first sheet transport is moving in a second direction toward the entrance station;

moving the first sheet transport and the sheet thereon in the first direction toward a sheet exit station;

fixing the position of the sheet relative to the first sheet transport; and moving the first sheet transport and the sheet thereon through the print zone.

DETAILED DESCRIPTION

Describing now in further detail these exemplary embodiments with reference to the Figures.

As used herein, "sheet of media", "substrate media" or "sheet" refers to a substrate onto which an image can be imparted. Media may include, paper, transparencies, parchment, film, fabric, plastic, photo-finishing papers, corrugated board, or other coated or non-coated substrate media upon which information or markings can be visualized and/or reproduced.

As used herein, "print zone" refers to the location in a media processing path in which an image is imparted to the sheet of media.

As used herein, "media entrance station" refers to a location in the media processing path where the sheet of media is transferred from one portion of the processing path into another portion of the processing path.

As used herein, "media exit station" refers to a location in the processing path wherein the sheet of media is transferred from one portion of the processing path out of another portion of the processing path.

As used herein, "a media transport" is a device or devices which move a sheet of media along the media processing path.

As used herein, "sled" refers to a media transport device translatable in the possess path and having a surface for supporting a sheet of media.

As used herein, "belt assembly" refers to a device including at least one belt for transporting a sheet of media along a process path.

Figure 1:
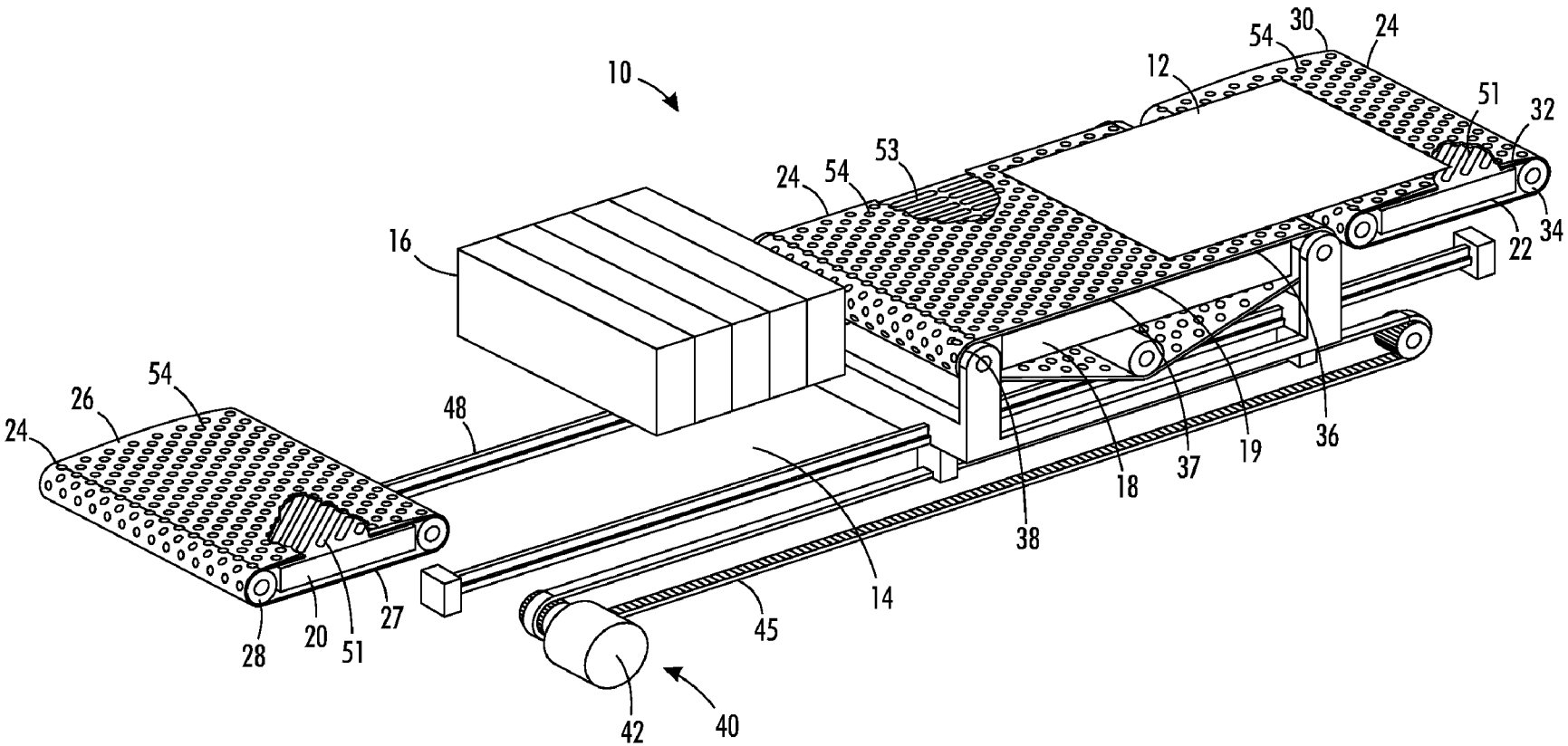
FIG. 1 is a perspective view of media transport system in accordance with an aspect of the disclosed technologies.
Figure 2:
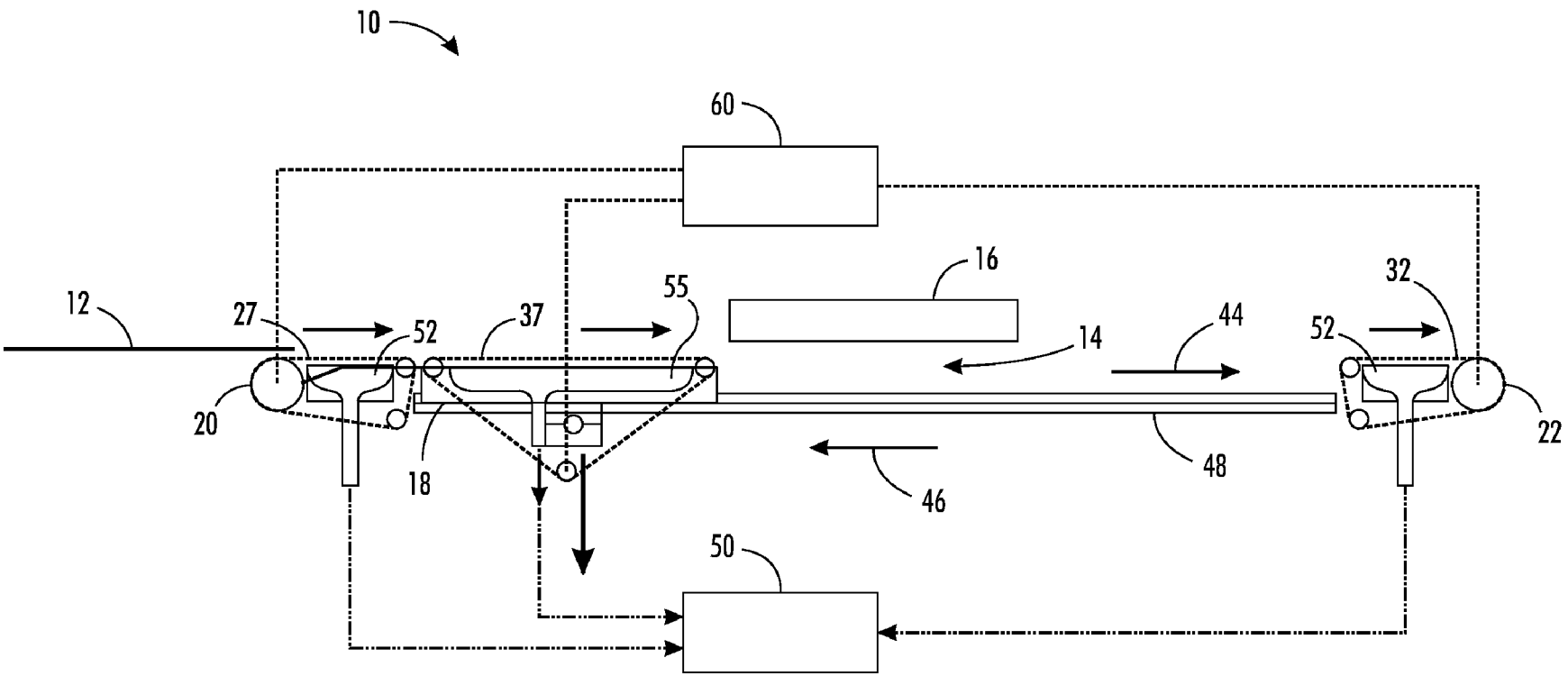
FIG. 2 is a side elevational schematic view of the transport system of FIG. 1.

With reference to FIGS. 1 and 2, a media transport system 10 is shown which moves a sheet of substrate media 12 through a print zone 14. It is in the print zone 14 where an image is imparted to the substrate media 12 by an image transfer device 16. The image transfer device 16 may be one of a variety of devices for generating an image including, but not limited to, a direct image transfer device, such as an ink jet system, xerographic, flexographic or lithographic system.

The image transport system 10 may include a first sheet transport in the form of a sled 18 having a generally planar upper surface 19 which supports the substrate media 12 thereon. The sled 18 may travel in a reciprocal manner between a media entrance station 20 and a media exit station 22 and through the print zone 14. When the sled 18 reaches the end of its travel in a first direction 44 toward the exit station 22, its direction of travel is changed and the sled starts moving in a second direction 46 toward the entrance station 20. At the entrance station 20, the media 12 is transferred onto the sled 18, and at exit station 22 the media 12 is transported off of the sled and further along the media processing path.

The sled 18 may be operably connected to a sled drive 40 which includes a motor 42 and a drive belt 45. The sled drive 40 causes the sled to move in a first direction 44 and a second and opposite direction 46 between the media entrance station 20 and the media exit station 22. The sled may be further guided in its movement by a pair of spaced linear guide members 48.

The transport system 10 further includes a second sheet transport in the form of a belt transport system 24 which cooperates with the sled 18 for transporting the media 12 between the entrance and exit stations. The belt transport system 24 may include an entrance belt assembly 26 disposed on the media entrance station 20. The entrance belt assembly 26 may include a continuous entrance belt 27 which is operably supported on a pair of rollers 28, and driven by a drive (not shown). The belt transport system 24 may further include an exit belt assembly 30 disposed on the media exit station 22. The exit belt assembly 30 may be formed similar to the entrance belt assembly and may include a continuous exit belt 32 operably supported on rollers 34 and driven by drive (not shown).

The belt transport system 24 may further include a sled belt assembly 36 which is disposed on and carried by the sled 18. Each of the sled, entrance, and exit belt assemblies and may be independently controlled in order to transport the media 12 in a desired manner. The sled belt assembly 36 may include a continuous sled belt 37 operably supported by rollers 38 and driven by a drive (not shown). The entire sled belt assembly 36 including the sled belt 37 travels with the sled 18 as it moves between the entrance station 20 and exit station 22. The sled belt 37 circulates on and moves relative to the sled 18. The sled belt 37 has a path which carries it across the sled upper surface 19. Therefore, media 12 supported on the sled belt 37 can be transported at a velocity relative to ground, i.e., a fixed reference point, different than the velocity of the sled 18 relative to ground itself. The media velocity will be the sum of the sled belt velocity and the sled velocity.

The media entrance station 20, sled 18, and media exit station 22, may be in communication with vacuum sources 50, shown in FIG. 2. The entrance station 20 and exit station 22 may include a surface having apertures 51 therein which lead to vacuum plenum 52 in operative communication with the at least one vacuum source 50. It is to be understood that that separate vacuum sources could be used for each of the entrance station, 20 exit station 22, and sled belt assembly 36. The sled surface 19 may also include apertures 53 therein leading to a vacuum plenum 55 disposed within the sled. The plenum 55 is in operative communication with the at least one vacuum source 50. The entrance, exit and sled belts, 27, 32 and 37 may include openings 54 therein in order to permit a vacuum to be drawn through the surface of the belts so that the vacuum may operate on the media 12. The vacuum assists in retaining the media sheet 12 to the surface of the belts as it is transported through the media transport system 10. The vacuum level at the entrance and exit stations 20 and 22 as well as the sled 18 may be independently controlled.

The operation of the sled 18 may be governed by a controller 60. The controller 60 may also control the operation of the media entrance station 20 and media exit station 22. The controller 60 may also control the level of vacuum generated. The controller 60 may include one or more processors and software capable of generating control signals. Through the coordinated control of the entrance belt assembly 26, the sled belt assembly 36 and the exit belt assembly 30, and the control of the movement of the sled 18 its self, the substrate media may be efficiently moved through the print zone 14.

Figure 3:
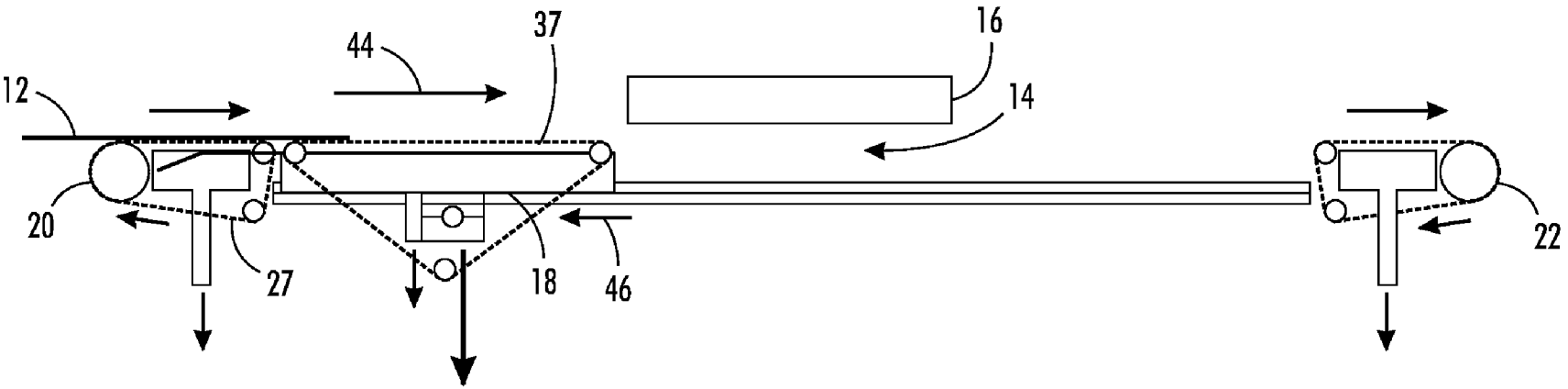
FIG. 3 is a side elevational schematic view of the transport system of FIG. 1 showing a sheet of media being transported from an entrance station onto a sled.

As the sled 18 is moved in the second direction 46 toward the entrance station 20, the entrance belt assembly 26 may be driven to transport the substrate media 12 toward and onto the sled 18 as shown in FIG. 3. The transport of the substrate media 12 onto the sled 18 may begin before the sled fully reaches the end of its travel toward the entrance station 20. As the substrate media 12 is moved onto the sled 18, action by the sled belt 37 moves the substrate media 12 further onto the sled. As the media 12 is being transported onto the sled 18, the direction of the sled 18 is reversed. By controlling the speed of the entrance belt 27 and the sled belt 37, the substrate media 12 is transported in the first direction 44 onto the sled 18 while the sled 18 is itself moving in the second direction 46 toward from the entrance station 20. The sled 18 decelerates, stops, and accelerates in the first direction 44 while the sled belt 37 it moving substrate media 12 onto sled 18. This is achieved by driving the sled belt 37 on the sled faster than the velocity of sled itself so the substrate media 12 can advance forward relative to the sled 18.

Figure 8:
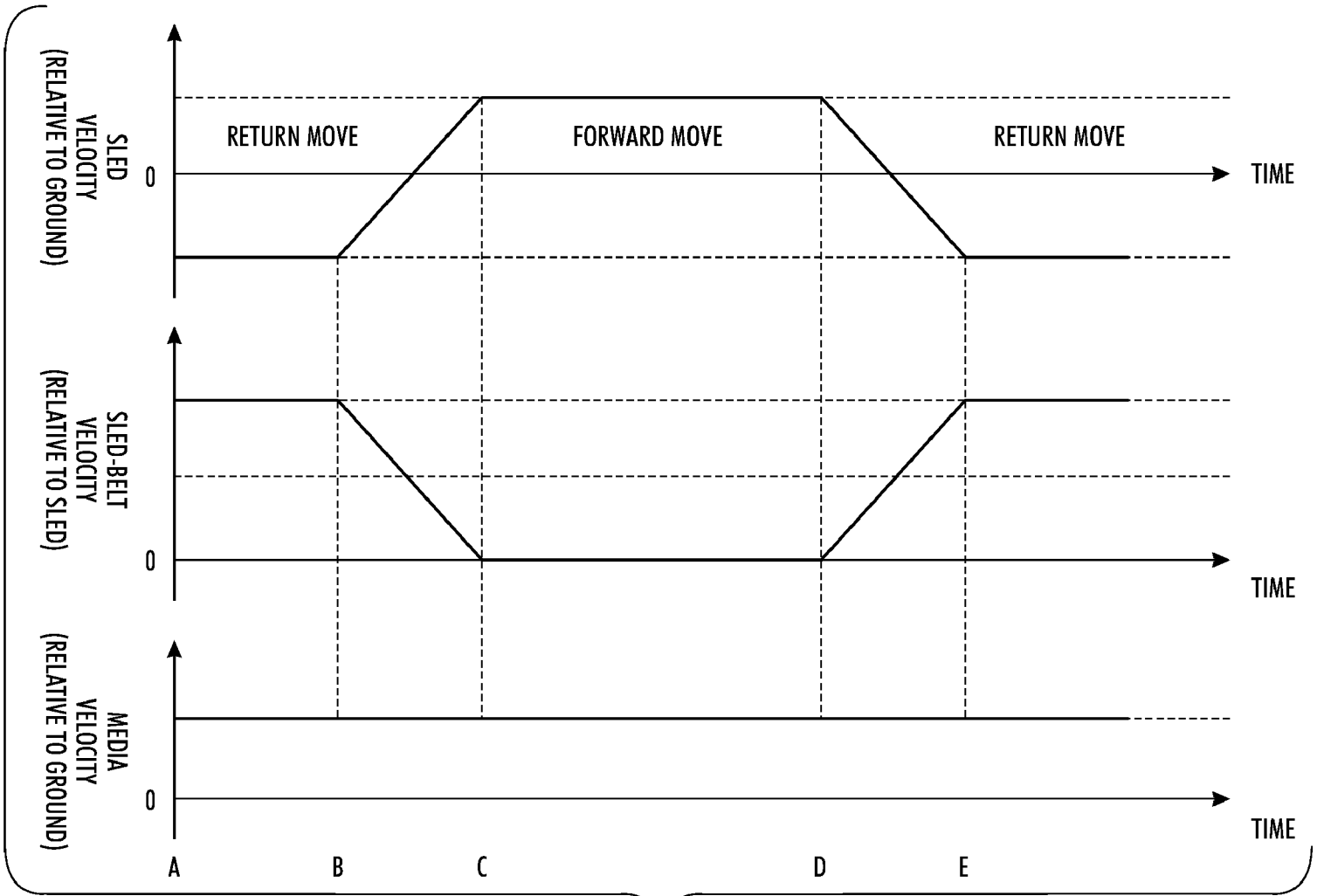
FIG. 8. is a graphical representation of the sled, the sled belt and media velocities.

The relationship between the velocity of the sled 18, the sled belt 37, and the sheet of media 12 is illustrated in the velocity vs. time diagrams of FIG. 8. As shown in FIG. 8, the sum of the velocity of the sled 18 and the sled belt 37 gives a generally constant transport velocity to the media 12. Between time A and B, the sled 18 is traveling in the second direction 46 toward the entrance station 20 at a constant velocity. During this time, the sled belt 37 is moving across the top surface of the sled in an opposite first direction 44 (toward the exit station) and at a velocity relative to the sled 18 to move the sheet onto the sled. At time B, the sled 18 begins to slow down, and therefore, the sled belt 37 also slows down to keep the sheet 12 at the constant transport velocity. When the sheet 12 is moved to the desired location on the sled, the sled belt 37 stops moving relative to the sled 18 as shown at time C. Between time C and D, the sled belt 37 and sheet 12 carried thereon, move at the same velocity as the sled 18. During this portion of the sled travel, the image is imparted onto the sheet. Between time D and E, the sled begins to approach the exit station 22 and slow down and then reverse direction as shown by the negative velocity. The sled belt 37 begins moving relative to the sled 18 to keep the sheet moving at a desired velocity. At time E, the sled 18 is returning to the entrance station at a constant velocity and the sled belt 37 is also moving at a constant and opposite velocity to keep the sheet 12 moving toward the exit station 22.

Figure 4:
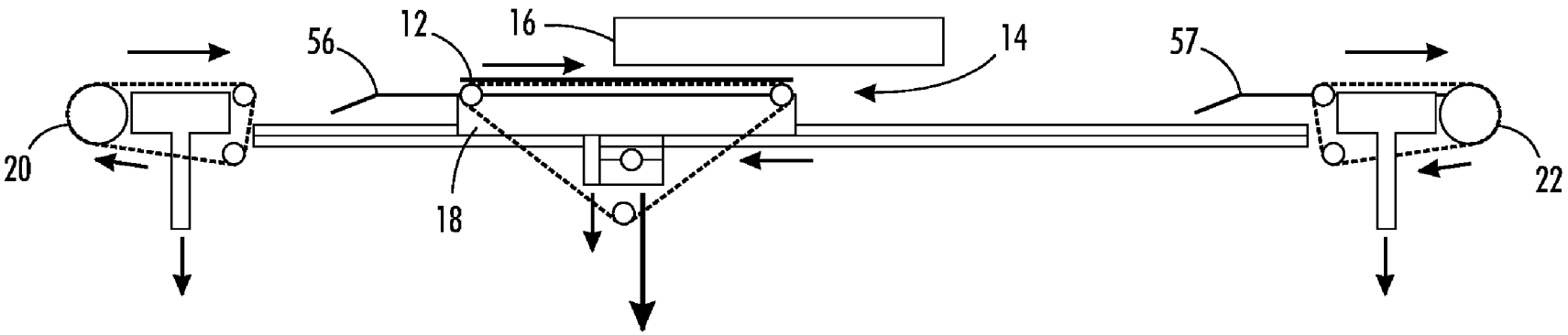
FIG. 4 is a side elevational schematic view of the transport system of FIG. 1 showing the sheet of media on the sled and passing through the print zone.

During the movement of the substrate media 12 onto to the sled 18, a relatively low vacuum level may be employed at the sled surface 19 in order to permit the sled belt 37 to move the substrate media 12 relative to the sled surface 19. However, even the low vacuum level helps maintain the sheet in contact with sled belt 37 so that the sheet may be properly positioned on the sled. Once the media 12 reaches the desired position on the sled 18, the sled belt 37 stops moving and a high vacuum level may be applied to the surface of the sled. This draws the sheet and the sled belt 37 toward the sled surface 19 fixing the position of the sheet on the sled 18 and holding the media very flat to reduce the risk that any portion of the media will come in contact with the print heads during imaging. In this state, the media 12 moves at the same velocity as the sled 18 relative to ground as shown in FIG. 4.

Fixing the position of the substrate media 12 on the sled 18 preferably occurs before the sheet enters the print zone 14. The only factor affecting the velocity of the media 12 through the print zone 14 is the velocity of the sled itself Precise control of the velocity of the sled 18 may be achieved by way of the sled drive 40 operating in conjunction with a controller 60. This allows for a high quality image to be transported to the media. Such high quality transfer can be achieved by maintaining a constant velocity of the sled 18 throughout the entire travel through the print zone 14. After the sled 18 has passed through the print zone 14, the velocity of the media 12 may be increase if desired in order to increase the throughput of the transport system 10.

The high vacuum level applied to the substrate media 12 through the sled, also holds the media flat through the print zone 14 improving image quality. This is especially helpful in situations where the media is relatively thick, e.g. corrugated board, or when the media is relatively large sheets which require significant force to hold down over the large area.

As the sled 18 carrying media 12 approaches the media exit station 22, and the velocity of the sled may be decreased. The controller 60 may also adjust the vacuum level to the lower vacuum setting to permit the media 12 to move relative to the sled 18. The sled belt 37 is then accelerated to keep the velocity of the media 12 generally constant to drive the media off of the sled 18 and onto the exit station 22. The exit belt assembly 30 is also activated by the controller 60 to transport the substrate media 12 off of the sled and along the processing direction. The vacuum plenum 52 of the exit station 22 when subjected to a vacuum draws the media 12 into contact with the exit belt 32 as it is pulled off sled belt 37 and moved through the exit station 22.

Figure 5:
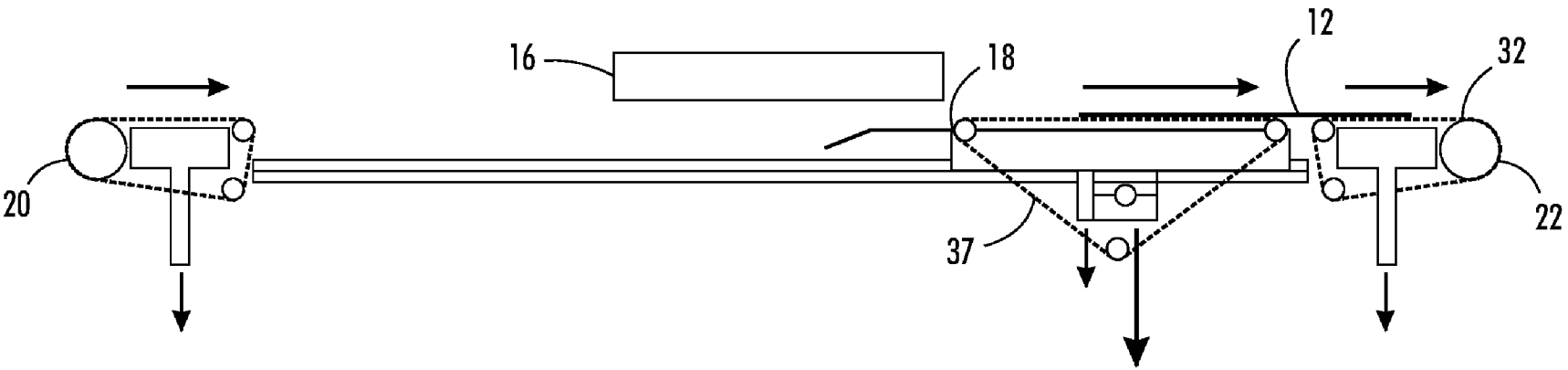
FIG. 5 is a side elevational schematic view of the transport system of FIG. 1 showing the sheet of media being transported from the sled to an exit station.

Once a predetermined portion of the substrate media 12 is captured by the media exit station 22, the sled 18 may begin traveling in a second direction 46 away from the exit station 22 as shown in FIG. 5. During this movement of the sled 18, the speed of the sled belt 37 may be increased such that the substrate media velocity remains constant and the media is still being driven by the sled belt assembly 36 in the first direction 44 toward the exit station 22. The speed of the sled and exit belts, 37 and 32 are set such that the substrate media 12 is transferred smoothly from the sled 18 onto the exit station 22. Accordingly, the sled 18 may begin its movement back toward the entrance station 20 before the substrate media 12 is fully unloaded therefrom. This allows the throughput of the media transfer station 10 to be increased. The sled 18 may be transferred via the drive in the second direction 46 towards the media entrance station 20. The cycle then repeats itself with the entrance station's belt assembly 26 driving another sheet into the sled 18 as it approaches the entrance station 20.

By independently controlling the speed of the sled 18 and the various belts, the sled can be moved in a direction opposite that of the sheet. The sled belt 37 on which the media is supported, may move at different speed and directions. Therefore, the effective surface velocity of the sled, as determined by the speed and direction of sled belt 37, can be different than the actual velocity of the sled itself. Therefore, the sled 18 can be moved at a velocity that is different from the velocity of the sheet as carried by the sled belt. This allows the sled 18 to can begin movement towards the next step in its operation while still completing the transfer of the sheet of media 12.

An exemplary operation of the transport system as shown in FIGS. 1-5 includes the media 12 being driven onto the sled 18 by the entrance belt 27 and by moving the sled belt 37 at a speed such that the velocity of the sled belt 37 matches the velocity of the media 12. The sled 18 may use the low pressure setting during this operation such that the media 12 may move relative to the sled with minimal friction between the sled belt and the sled upper surface 19. As soon as the media 12 is completely on the sled 18 in the proper position, the sled 18, carrying the sled belt 37 and media 12 thereon, may accelerate to match the media speed while the sled belt 37 is simultaneously decelerated to keep the media 12 moving at a constant velocity. After the sleds belt 37 comes to a stop, high vacuum level is applied and the sled 18 continues moving toward the print zone 14. The media 12 is then driven through the print zone 14 by the sled 18 at a constant velocity. After exiting the print zone 14 the sled vacuum level may be reduced to the low level as the sled continues to move in the first direction 44. When the sled 18 nears the end of its travel toward the exit station 22, the velocity of the sled may be slowed down and the sled belt 37 accelerated to keep the media velocity generally constant as the sheet is driven off the sled 18 onto the exit station 22. As the sled 18 changes direction and moves in the second direction 46, the sled belt 37 continues to drive at a high velocity to keep the sheet of media 12 moving in the first direction at a constant velocity. Accordingly, as the sled 18 slows down to move in to its final position at the exit station and as it begins its return motion, due to its speed of the sled belt 37; the velocity of the sheet 12 remains the same. Since the sled 18 can be returning to acquire a new sheet, as that new sheet is being driven in the first direction 44 by entrance belt assembly 26, there is an opportunity for the lead edge of the media 12 to droop down before the sled 18 is in place to support it. To prevent stubbing problems, a lead in guide 56 can be positioned on the sled as shown in FIG. 4. Optionally, a guide 57 could be positioned on the exit belt assembly 30 in order to support the trail edge of the media as the sled begins it return move.

Accordingly, reasonably high productivities and throughput can be achieved even with large sheets of media and a quality image may be created on the substrate media 12.

Figure 6:
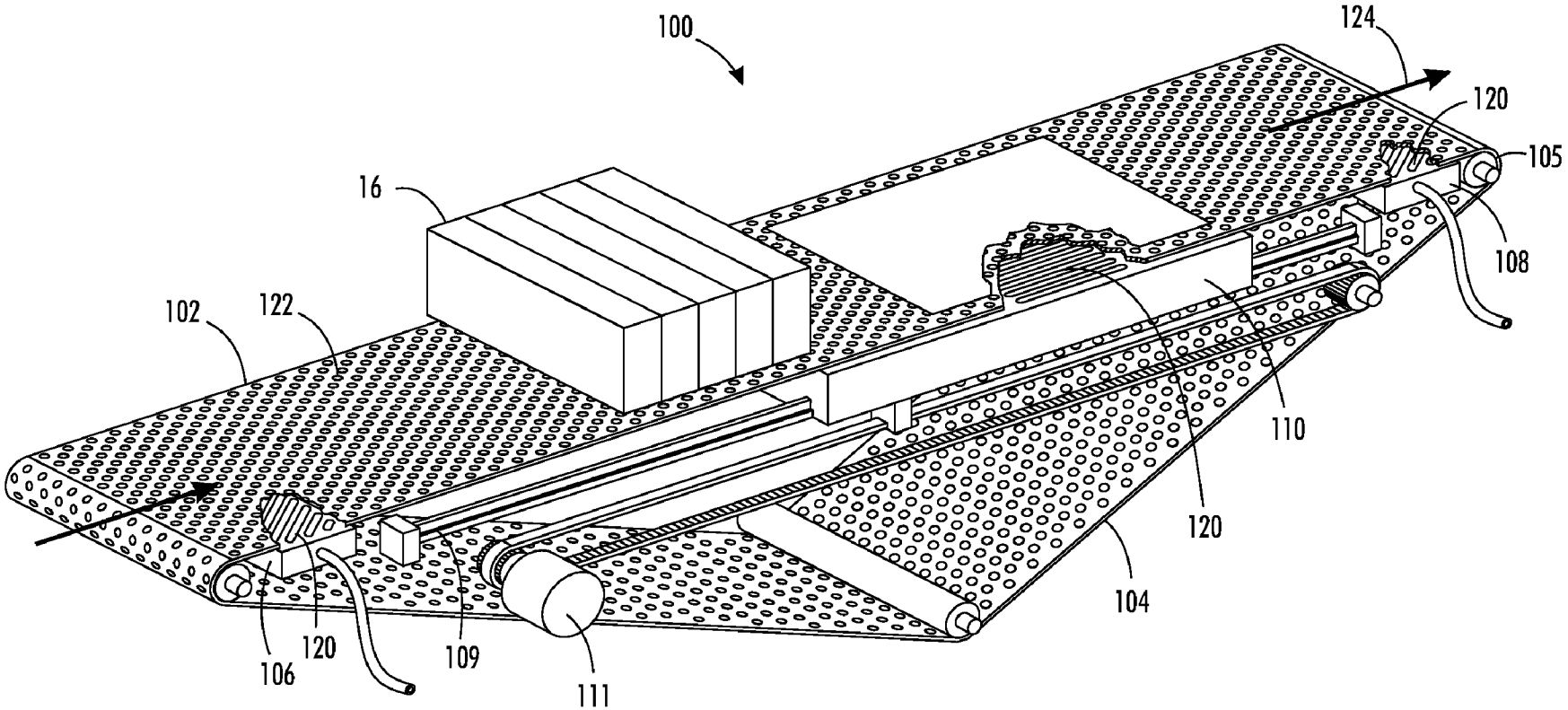
FIG. 6 is a perspective view of an alternative embodiment of a media transport system in accordance with an aspect of the disclosed technologies.
Figure 7:
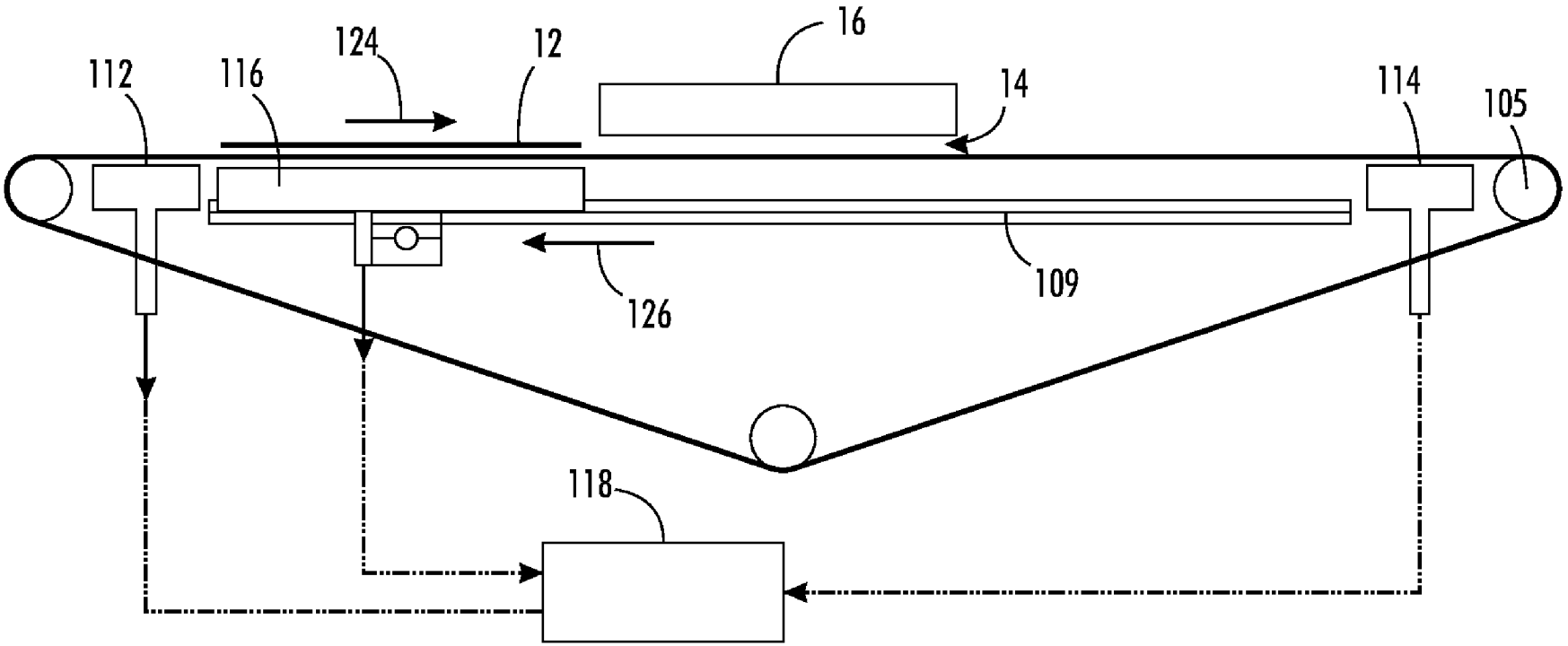
FIG. 7 is a side elevational schematic view of the transport system of FIG. 6 showing the sheet of media on the sled and belt approaching the print zone.

With references to FIGS. 6 and 7 a further embodiment of the media transport system 100 is shown. The transport system 100 moves substrate media 12 through a print zone 14 wherein an image is imparted by an image transfer device 16. In this embodiment, the belt transport system 102 includes a main continuous belt 104 which extends over entrance station 106 and exit station 108 as well as over sled 110. The main belt 104 may be driven by a belt drive including rollers 105. The sled 110 may be moved back and forth on a linear guide 109 between the entrance station 106 and exit station 108 by a sled drive 111.

The entrance station, exit station and sled include air plenums 112, 114 and 116 respectively, operably connected to a vacuum source 118. Upper surfaces in the plenum include apertures 120 such that the vacuum may be transmitted to the belt 104 and the media 12 carried thereby. The belt 104 may include an array of openings 122 such that the vacuum may be transferred to a sheet carried by the belt 104. The entrance and exit stations 106 and 108, and sled 110 are attached to vacuum source 118. The vacuum level applied to the sled plenum 116 may be adjusted between high and low as in the embodiment shown in FIGS. 1-5.

In the present embodiment, the movement of the belt 104 is independent of the movement of the sled 110. Accordingly, the velocity, including the speed and direction of the belt 104, may be different than the velocity of the sled 110. When a sheet of media 12 is moved from the entrance station 106 onto the sled, the belt 104 may move in the first direction 124 toward the exit station 108 while the sled 110 is moving in a second direction 126 away from the exit station 108.

The belt 104 may be run at a constant velocity. As the sled 110 approaches the entrance station 106, the substrate media 12 is driven onto the sled by rotating the belt 104 and using the low pressure setting on the sled 110. As soon as the sheet 12 is positioned over the sled 110, the sled accelerates to match the velocity of the sheet and then high vacuum level is applied. The vacuum pulls the media onto the sled 110, and the sled 110, belt 104 and media 12 may move together at the same velocity. The sheet 12 is driven under the print zone 14 with the sled providing the primary velocity control. Alternatively, the belt 104 could be in torque control mode during this time period. In torque control mode, the sled 110 would be driven using a current profile that was just sufficient to overcome the inherent friction drag and inertia forces of the sled. With this system, the bulk of the drive for the sled would come from the sled drive system, and only the minor variations in required sled drive force would come from the belt system, which would be under tight velocity control.

Once the sled 104 moves past the print zone 14, the low vacuum may then be applied to the sled 110 as the sled approaches the exit station 108. When the sled 110 decelerates as it reaches the end of its travel toward the exit station 108, the belt 104 keeps turning at a constant velocity to drive the substrate media off the sled 110 and onto the exit station 108. The velocity of the sled 110 may be reduced but the velocity of the top surface of the belt 104 relative to the ground may kept at a constant velocity to keep the media moving toward the exit station 108. Before the media is fully moved from the sled 110, the sled may begin its travel back towards the entrance station 106 along the second direction 126. However, the belt can continue to move the media in the first direction 124 onto the exit station 108 and along a media processing path. The next sheet of media 12 is moved by the belt 104 toward and onto the sled 18 while the sled is still completing the return motion. This process is then repeated.

It will be appreciated that variations of the above-disclosed and other features and functions, or alternative thereof, may be desirably combined into many other different systems or applications. Various presently unforeseen or unanticipated alternatives, modifications, variations, or improvements therein may be subsequently made by those skilled in the art which are also intended to be encompassed by the following claims. In addition, the claims can encompass embodiments in hardware, software, or a combination thereof.

What is claimed is:

1. A system for transporting a sheet of media through a print zone comprising:

a media entrance station;

a media exit station;

a first media transport translatable in a reciprocal manner between the entrance and exit stations;

a second media transport for transporting the sheet onto and off of the first media transport; and the second media transport transporting the sheet in a first direction as the first media transport is moving in a second opposite direction, and wherein the first media transport includes a sled and the second media transport includes a sled belt assembly operably connected to the sled and movable therewith, the sled belt assembly including a sled belt being controllable to move the sheet relative to the sled.

2. The system as defined in claim 1, wherein the second media transport transports the sheet from the entrance station onto the first media transport while the first media transport is moving toward the entrance station.

3. The system as defined in claim 1, wherein the second media transport transports the sheet from the first media transport onto the exit station while the first media transport is moving toward the entrance station.

4. The system as defined in claim 1, wherein the first media transport includes the sled having an upper surface for supporting the sheet, and the upper surface is in fluid communication with a vacuum source.

5. The system as defined in claim 4, wherein a first vacuum level is generated when the sheet is moving relative to the sled, and a second vacuum level higher than the first vacuum level is generated when the sheet is moving at the same speed as the sled.

6. The system as defined in claim 1, wherein the first media transport is moved at constant velocity past the print zone.

7. The system as defined in claim 1, wherein a velocity of the second media transport relative to ground is controlled to be different than a velocity of the first media transport relative to ground when the sheet is entering and exiting the first media transport.

8. The system as defined in claim 1, wherein a velocity of the second media transport relative to ground is controlled to match a velocity of the first media transport relative to ground when the first media transport is moving past the print zone.

9. The system as defined in claim 1, wherein the sled belt is controllable to maintain the sheet at a predetermined position on the sled as the sled translates past the print zone.

10. The system as defined in claim 1, wherein the second media transport includes at least one of an entrance belt assembly operable connected to the entrance station, the entrance belt assembly being controllable to transport the sheet onto the sled, and an exit belt assembly operably connected to the exit station, the exit belt assembly being controllable to transport the sheet off of the sled.

11. A sheet media transport for moving a sheet of media through a print zone comprising:

a media entrance station;

a media exit station;

a sled translatable in a reciprocal manner between the entrance and exit stations, the sled having a surface in operative communication with a vacuum; and a belt assembly for transporting the sheet onto and off of the sled, the belt assembly including a sled belt which is translatable with the sled between the entrance and exit stations, the belt assembly transporting the sheet in a first direction as the sled is moving in a second opposite direction.

12. The transport system as defined in claim 11, wherein the vacuum is selectable between a first vacuum level to permit movement of the sheet relative to the sled, and a second vacuum level higher than the first level for restricting movement of the sheet relative to the sled.

13. The transport system as defined in claim 11, wherein the sled belt is movable across an upper surface of the sled in a direction opposite to a direction of travel of the sled.

14. The transport system as defined in claim 11, wherein an upper surface of the sled is subject to a second vacuum level when the sled moves through the print zone, and a velocity of the sled belt relative to ground equals a velocity of the sled relative to ground when the sled moves though the print zone.

15. A method for transporting sheets of media through a print zone comprising:

translating a first sheet transport toward a sheet entrance station;

operating a second sheet transport for moving a sheet of media in a first direction onto the first sheet transport while the first sheet transport is moving in a second direction toward the entrance station, the second sheet transport including a first belt assembly including a first belt operably connected to the first sheet transport and movable therewith, a velocity of the first belt being responsive to the position of the first sheet transport;

moving the first sheet transport and the sheet thereon in the first direction toward a sheet exit station;

fixing a position of the sheet relative to the first sheet transport; and moving the first sheet transport and the sheet thereon through the print zone.

16. The method as defined in claim 15, including operating the second transport to move the sheet onto the exit station when the first transport is moving in the second direction toward the entrance station.

17. The method as defined in claim 16, including applying a first vacuum level to the first sheet transport to fix the sheet thereto when the sheet is moved through the print zone.

* * * * *